United States Patent [19]

Inada et al.

[11] 4,151,819

[45] May 1, 1979

[54] EXHAUST GAS PRESSURE RESPONSIVE VALVE ASSEMBLY

[75] Inventors: Masami Inada, Toyoake City; Kenji Hashimoto, Anjo City, both of Japan

[73] Assignee: Aisin Seiki Company, Limited, Aichi, Japan

[21] Appl. No.: 810,627

[22] Filed: Jun. 27, 1977

[30] Foreign Application Priority Data

Jun. 25, 1976 [JP] Japan ..... 51-84183[U]

[51] Int. Cl.[2] ..... F02M 25/06

[52] U.S. Cl. ..... 123/119 A; 251/61; 251/61.2; 251/61.4; 251/58

[58] Field of Search ..... 251/61, 61.4, 61.2, 251/368, 58; 123/119 A; 60/278

[56] References Cited

U.S. PATENT DOCUMENTS

| | | | |
|---|---|---|---|
| 1,640,790 | 8/1927 | McClain | 123/119 A |
| 3,834,366 | 9/1974 | Kingsbury | 123/119 A |
| 3,929,314 | 12/1975 | Stratynski | 251/58 |
| 3,982,515 | 9/1976 | Bradshaw | 123/119 A |
| 4,031,871 | 6/1977 | Hamanishi | 123/119 A |
| 4,056,084 | 11/1977 | Baumgartner | 123/119 A |

*Primary Examiner*—Wendell E. Burns
*Attorney, Agent, or Firm*—Oblon, Fisher, Spivak, McClelland & Maier

[57] ABSTRACT

An exhaust gas pressure responsive valve assembly includes a first body of resinous material, a second body of metal material secured to the resinous material, a diaphragm member having an outer periphery held between both of the bodies so as to define an atmospheric chamber on the side of the resinous body and an exhaust gas pressure chamber on the side of the metal body, a spring biasing the diaphragm member against the exhaust gas pressure within the exhaust gas chamber, inlet and outlet ports provided in the resinous body, a passage provided in the resinous body for connecting the inlet and outlet ports, at least one metal plate secured to the diaphragm member, a guide member of resinous material secured to the metal plate, and a valve mechanism arranged within the guide member for controlling fluid communication between the passage and the atmospheric chamber in response to movement of the diaphragm.

8 Claims, 2 Drawing Figures

EXHAUST GAS PRESSURE RESPONSIVE VALVE ASSEMBLY

BACKGROUND OF THE INVENTION

1. Field of the Invention

This invention relates to a valve assembly and more particularly to an exhaust gas pressure responsive valve assembly.

2. Description of the Prior Art

The recirculation systems of exhaust gases have been developed as a method for reducing formation of oxides of nitrogen within exhaust gas during the combustion process in an internal combustion engine. These systems have valve means for controlling recirculation of exhaust gases in response to a vacuum signal produced responsive to the degree of opening of a throttle valve of a carburetor. Some of such prior systems further have an exhaust gas pressure responsive valve assembly which controls the above vacuum signal because it is desired to recirculate the exhaust gases at a rate proportional to the rate at which combustion air flows into the engine. These prior systems are disclosed, for example, in U.S. Pat. No. 3,834,366 and U.S. Pat. No. 3,802,402, wherein the above valve assemblies utilize exhaust back pressure, as signal pressure, to recirculate exhaust gases at a rate proportional to air flow. This means that a signal chamber of the valve assembly and conduits or pipes therefore are subject to exhaust gas which is high in temperature and exhibit acidic properties. At least a part of the exhaust gases transmitted to the signal chamber and conduits always remains even when it is desired to discharge the exhaust gas from the signal chamber or the like. Therefore, some considerations on materials of parts constituting the signal chamber or the like should be given to thereby reduce and prevent oxidation and corrosion of the above parts. Another consideration should also be given that the parts constituting valve portions or the like should be easy to manufacture because complex proceedings on some parts will be required.

However, prior valve assemblies have not taken into consideration the above mentioned problems so that there are drawbacks in that the first named-parts will be apt to be oxidized and corroded, and that the second named-parts will be quite difficult to manufacture.

SUMMARY OF THE INVENTION

It is an object of the present invention, therefore, to provide an improved exhaust gas pressure responsive valve assembly which obviates the above mentioned drawbacks.

It is another object of the present invention to provide an improved valve assembly of the type mentioned above which is high in durability.

It is a further object of the present invention to provide an improved valve assembly of the type mentioned above which is easy to manufacture and is low in cost.

In summary, the exhaust gas pressure responsive valve assembly according to the present invention includes a first body of resinous material, a second body of metal material secured to the resinous material, a diaphragm member having an outer periphery held between both of the bodies so as to define an atmospheric chamber on the side of the resinous body and an exhaust gas pressure chamber on the side of the metal body, a spring biasing the diaphragm member against the exhaust gas pressure within the exhaust gas chamber, inlet and outlet ports provided in the resinous body, a passage provided in the resinous body for connecting the inlet and outlet ports, at least one metal plate secured to the diaphragm member, a guide member of resinous material secured to the metal plate, and a valve means arranged within the guide member for controlling fluid communication between the passage and the atmospheric chamber in response to movement of the diaphragm.

The above construction means that the parts subject to exhaust gas pressure are made of metal material and the parts which are required to be manufactured by complex proceedings are made of resinous material so that the construction according to the present invention can obviate the various prior drawbacks. It is not necessary that even those parts requiring complex manufacture be made of special resinous material such as polyphenylene sulfide which is high in cost.

BRIEF DESCRIPTION OF THE DRAWINGS

Various other objects, features and attendant advantages of the present invention will be more fully appreciated as the same becomes better understood from the following detailed description when considered in connection with the accompanying drawings, in which.

DETAILED DESCRIPTION OF THE PREFERRED EMBODIMENTS

Figure 1:
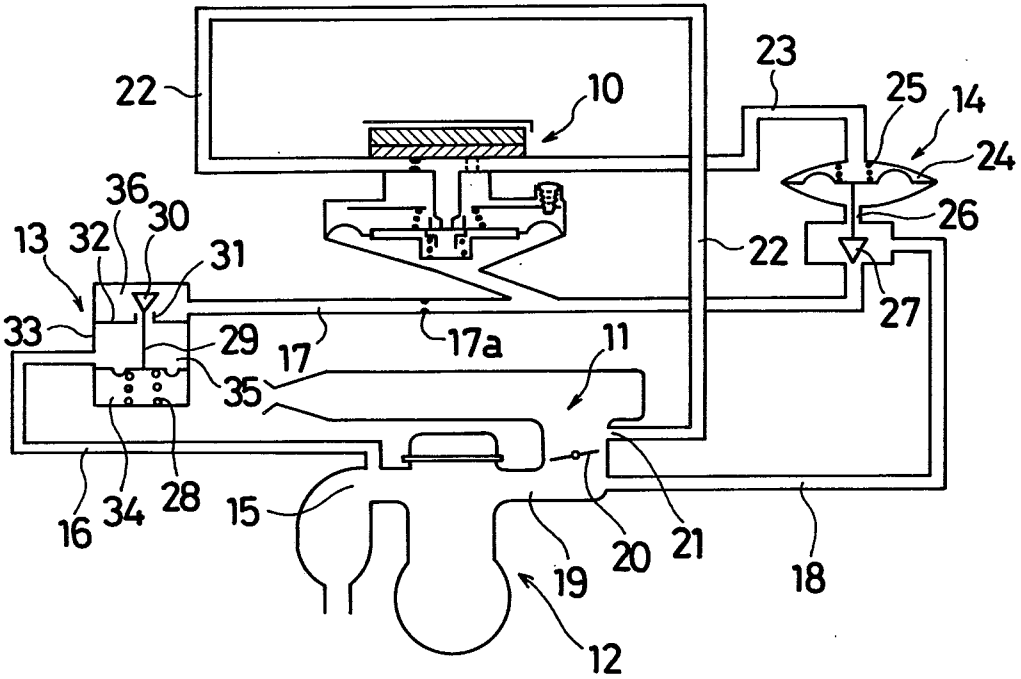
FIG. 1 is a schematic view showing a recirculation system of exhaust gas in which an exhaust gas pressure responsive valve assembly according to the present invention is arranged.

Referring now to the drawings, FIG. 1 illustrates an exhaust gas recirculation control system wherein an exhaust gas recirculation control valve assembly 10 according to the present invention is arranged. The exhaust gas recirculation system includes a carburetor 11, an engine 12, a first valve means 13 for interrupting recirculation of exhaust gas, and a second valve means 14 for controlling recirculation of exhaust gas. An exhaust manifold 15 of the engine 12 is fluidically connected to an intake manifold 19 through means of a conduit 16, the first valve means 13, a conduit 17, a second valve means 14 and a conduit 18 thereby providing an exhaust gas recirculation passage. As will be apparent hereinafter, a part of the exhaust gas at the exhaust manifold 15 will be recirculated through means of the recirculation passage to the intake manifold 19 during the specific condition of the engine operation so that the temperature of combustion at the engine combustion chamber will be decreased so as to reduce formation of oxides of nitrogen within the exhaust gas. The above recirculation passage is controlled by means of the control valve assembly 10 and the second valve means 14.

The second valve means 14 includes a vacuum chamber 24, a diaphragm-piston 26 having a valve portion 27 thereon and a spring 25 biasing the diaphragm-piston 26. The vacuum chamber 24 is adapted to receive vacuum produced at an advance port 21 of the carburetor 11 through means of a conduit 22, the control valve assembly 10 and a conduit 23. The vacuum produced at the advance port 21 is in response to the degree of opening of a throttle valve 20 which is mechanically connected to the accelerator pedal so that the valve portion 27 of the diaphragm-piston 26 is displaced against the biasing force of spring 25 to thereby allow fluid communication between conduits 17 and 18 when vacuum within the chamber 24 exceeds a predetermined value.

The first valve means 13 includes a diaphragm-piston 29 biased by a spring 28 and having a valve portion 30, a divider plate 32 having a valve seat 31, and an atmospheric chamber 34 and first and second exhaust gas chambers 35 and 36 defined within a body 33. The valve portion 30 is normally disengaged from the seat 31 by a biasing force of spring 28 so as to normally assure fluid communication between exhaust gas chambers 35 and 36, that is to say, conduits 16 and 17. When the exhaust gas pressure within the chamber 35 increases to an unexpected or abnormal value, the diaphragm-piston 39 is urged to be moved downwardly so that the valve portion 30 engages the seat 31 to thereby interrupt fluid communication between conduits 16 and 17.

The conduit 17 has an orifice 17*a* therein between the control valve assembly 10 and the first valve means 13.

Figure 2:
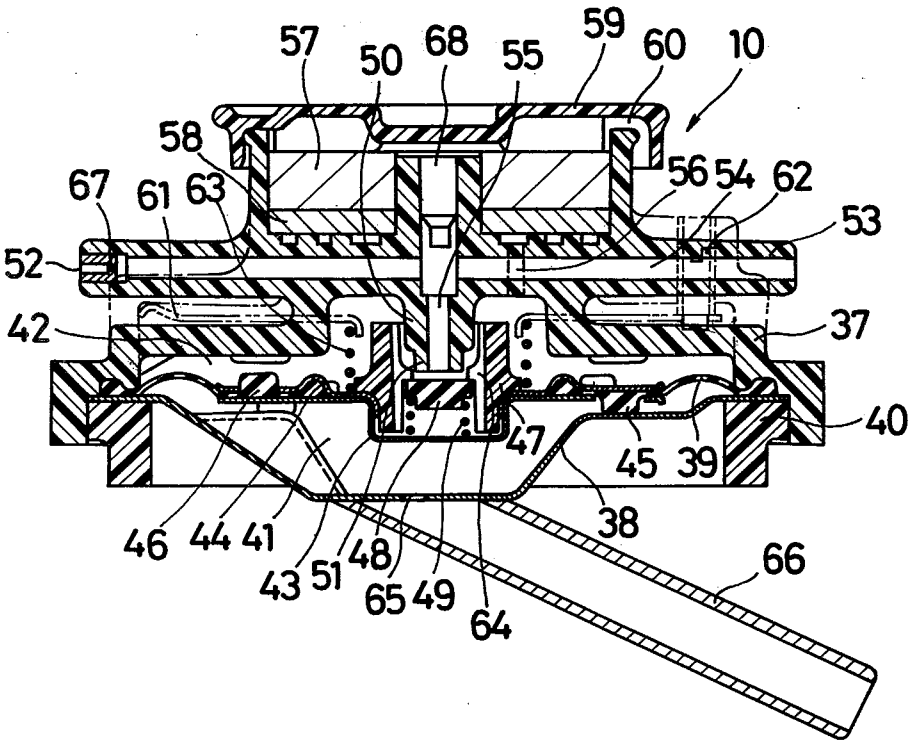
FIG. 2 is an enlarged cross-sectional view of the exhaust gas pressure responsive valve assembly.

Turning to FIG. 2, the construction of the control valve assembly 10 is explained in detail.

The control valve assembly 10 includes a first body 37 of resinous material such as polybutylene terephthalate (P.B.T.) material and a second body 38 of metal material such as stainless steel. A diaphragm member 39 arranged within bodies 37 and 38 has an outer periphery which is held between the bodies 37 and 38. Each outer periphery of the diaphragm member 39 and metal body 38 is held by means of resin body 37 and a holder 40, the holder 40 may also be of resinous material such as P.B.T. and may be secured to the resin body 37 by means of supersonic wave welding or the like. Thus an exhaust gas chamber 41 and an atmospheric chamber 42 are defined within bodies 37 and 38. The inner portion of diaphragm member 39 is positioned and held by means of a stainless steel plate 43 subject to exhaust gas chamber 41 and a stainless steel plate 44 subject to atmospheric chamber 42, both of plates 43 and 44 being securely welded to each other. The diaphragm 39 has downward extensions 45, through the plate 43, which is adapted so as to engage the metal body 38 and acts as a stop member to thereby limit downward movement of the diaphragm member 39. The diaphragm 39 also has upward extensions 46, through the plate 44, which are arranged so as to engage the resin body 37 and act as a stop member to thereby limit upward movement of the diaphragm member 39. A guide member 47 of P.B.T. resinous material is secured to the plate 44 by means of supersonic wave welding, and thus guide 47, diaphragm 39 and plates 43, 44 are moved as one body. Arranged within the guide 47 is a valve means 48 of a floating type which is always biased toward a valve seat 51 provided on a projection 50 of the resin body 37 by means of a spring 49 between valve means 48 and plate 43. The valve means 48 has high durability because it is of a floating type without trouble of wear during slidable movement thereof and it is not subject to exhaust gas.

The resin body 37 has an inlet port 52 connected to conduit 22 and an outlet port 53 connected to conduit 23, both of ports 52 and 53 being connected to each other through means of a passage 54 provided in the body 37. A passage 55 is provided in the projection of body 37 between atmospheric chamber 45 and passage 54 and is controlled by the valve means 48. The atmospheric chamber 42 is subject to atmosphere through means of a passage 56, first and second filter means 57, 58 and a passage 60, the passage 60 being defined between and by the body 37 and a closure member threadly fit therewith. The first filter means 57 may provide a depth filter for trapping relatively large foreign particles in the fluid flow, and the second filter means 58 may provide a paper filter for removing from the fluid passing through the first filter means relatively small foreign particles.

Disposed within the atmospheric chamber 42 is a retainer means 61 one end of which is brought in contact with the resin body 37 and the other end of which is brought in contact with a screw or thread means 63 threaded through the body 37. The retainer 61 has a central hollow portion in which the guide 47 can be slidable and receives a spring 63 at a position thereof adjacent to the hollow portion. The other end of spring 63 is seated against the plate 44 so that spring 63 biases plates 44, 43 and diaphragm 39 toward the metal body 38. Therefore, a projection 64 provided on the guide 47 causes the valve means 48 to be disengaged from the seat 51 so as to allow fluid communication between atmospheric chamber 42 and passage 54. The biasing force of spring 63 is adjustable by suitable turning of screw means 62. For example, the biasing force of spring 63 is increased when screw means 62 is screwed in and vice versa.

The metal body 38 has a port 65 so that the exhaust gas chamber 41 is adapted to receive the exhaust gas within the conduit 17 through means of a conduit 66 of stainless material which is welded to body 38. Thus the chamber 41 received exhaust gas in proportion to mass air-flow rate of the engine because of the mass of exhaust gas produced by the engine per unit time is directly proportional to mass air-flow rate of the engine. When the exhaust gas pressure within the chamber 41 overcomes the adjustable biasing force of spring 63, diaphragm 39 with plates 43, 44 and guide 47 are displaced upwardly and the valve means 48 is brought in contact with the seat 51 so as to close the passage 55. An orifice 67 is provided within the passage 54 near the port 52. The numeral 68 is a blind plug.

In operation, the recirculation passage between exhaust and intake maniflods 15 and 19 is controlled by means of second valve means 14. This valve means 14 is controlled by a vacuum signal within vacuum chamber 24 which is connected to the advance port 21 of carburetor 11 by means of conduits 22, 23. During engine conditions such as engine idling, decelerating operation of engine or the like, throttle valve 20 is in its substantial close position and there is no vacuum produced at advance port 21. During high load engine conditions such as running at high speed and running on an ascent, the throttle valve 20 is in its substantial full open position and vacuum produced at advance port 21 is not enough to displace the diaphragm-piston 26 against the biasing force of spring 25. As long as the engine occupies the above operating conditions, the valve portion 27 of the diaphragm-piston 26 is maintained in its closed position to thereby prevent recirculation of exhaust gas.

During intermediate load engine conditions such as running at normal or intermediate speed, vacuum will be produced at advance port 21 in response to the degree of opening of the throttle valve 20. When vacuum exceeds a predetermined pressure, diaphragm-piston 26 will be movable against the biasing force of spring 25 to thereby cause the valve portion 27 to be spaced away from the seat. This means that fluid communication between conduits 17 and 18 will be complete and recirculation of exhaust gas will be possible. As long as the number of the engine revolution is less than a predetermined value, however, parts of the exhaust gas pressure responsive valve assembly 10 occupy their illustrated positions as shown in FIG. 2, and air is bled into passage 54 which leads to vacuum chamber 24 via conduit 23. Therefore, the chamber 24 of the valve means 14 receives no vacuum even during the intermediate load engine conditions so that the valve portion 27 is still in its closed position wherein fluid communication between conduits 17 and 18 is still interrupted.

When the number of engine revolution exceeds the predetermined value during the intermediate load engine conditions, the exhaust gas pressure within exhaust gas chamber 41 transmitted through means of conduits 16 and 17 urges to displace diaphragm 39, plates 43, 44 and guide 47 upwardly against spring 63 whereby the valve means 48 is brought in contact with the seat 51. Now, air is not bled into passages 55 and 54 and vacuum chamber 24 of the second valve means 14 receives vacuum produced at advance port 21 which is enough to displace the diaphragm-piston 26. This results in that valve portion 27 is spaced away so as to complete fluid communication between conduits 17 and 18 and part of the exhaust gas can be recirculated from the exhaust manifold 15 to the intake manifold 19. Due to arrangement of the orifice 17*a* within conduit 17, exhaust gas pressure between the orifice 17*a* and the intake manifold 19 is decreased when exhaust gas is recirculated. In other words, the exhaust gas pressure within the exhaust gas chamber 41 is decreased. The diaphragm 39 with guide 47 will be moved downwardly by means of spring 63 and the projection 64 of guide 47 causes the valve means 48 to be open. Accordingly, atmospheric chamber 42 is in re-communication with passage 55 and air is bled into passage 54, again. The degree of vacuum pressure within the chamber 24 is quickly reduced due to arrangement of orifice 67 so that the valve portion 27 of diaphragm-piston 26 interrupts recirculation of exhaust gas. This results in re-increasing of exhaust gas pressure within conduit 17 or exhaust gas chamber 41. The valve means 48 may be in contact with seat 51 so as to prevent air bleed into passage 54, and thereafter the above operation may be re-cycled. Thus, desirable recirculation of exhaust gas will be attained proportionally to exhaust gas pressure at exhaust manifold 15, namely, combustion air flows into the engine.

Assuming that the exhaust gas pressure at exhaust manifold 15 increases abnormally or unexpectedly, the abnormal exhaust gas pressure transmitted to chamber 35 of first valve means 13 urges diaphram-piston 29 to be moved downwardly aganst spring 28 so that valve portion 30 is brought in contact with seat 31. Thus transmission of exhaust gas to conduit 17 and exhaust gas chamber 41 is interrupted, and the diaphragm 39 is not subject to the abnormal exhaust gas pressure. This means that the durability of diaphragm 39 or the like will be increased.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An exhaust gas pressure responsive valve assembly comprising:

a first body of resinous material, a second body of metal material, a holder of resinous material welded to said first body to thereby hold said second body therebetween;

a diaphragm member arranged within both of said bodies and having an outer periphery held between said bodies so as thereby to define an atmospheric chamber on the side of said resinous body and an exhaust gas pressure chamber on the side of said metal body, said diaphragm member being movable in response to exhaust gas pressure within said exhaust gas chamber, spring means biasing said diaphragm member against the exhaust gas pressure within said exhaust gas chamber, inlet and outlet ports provided in said resinous body, respectively, a passage provided in said resinous body for connecting said inlet port and said outlet port, at least one metal plate secured to said diaphragm member, a guide member of resinous material secured to said metal plate, and valve means arranged within said guide member for controlling fluid communication between said passage and said atmospheric chamber in response to movement of said diaphragm member.

2. A valve assembly as set forth in claim 1, wherein said valve means comprises a valve body of floating type and a spring biasing said valve body in its closed position wherein said valve body seats against a seat providing on said resinous body, and said guide member has a projection which causes said valve body to be disengaged from said seat against said spring of said valve means.

3. A valve assembly as set forth in claim 1, wherein said first body is made of polybutylene terephthalate material so as to reduce and prevent oxidation and corrosion, and said second body is made of stainless material.

4. A valve assembly as set forth in claim 1, wherein said diaphragm member has extensions which act as stop means for limiting the excessive movement of said diaphragm member.

5. A valve assembly as set forth in claim 1, further comprising:

means for adjusting the biasing force of said spring means.

6. A valve assembly as set forth in claim 5, wherein said means for adjusting the biasing force of said spring means comprises a retainer against which said spring means is seated and an adjusting screw for displacing the position of said retainer.

7. An exhaust gas recirculation system for recirculating part of exhaust gas comprising a recirculation passage between an exhaust manifold and an intake manifold, valve means arranged within said recirculation passage for controlling recirculation of the exhaust gas in response to vacuum signal produced responsive to an opening degree of a throttle valve of a carburetor, said valve means having a vacuum chamber for receiving said vacuum signal and a valve portion for opening and closing said recirculation passage in response to the degree of said vacuum signal, an exhaust gas pressure responsive valve assembly arranged within said recirculation passage between said exhaust manifold and said valve means positioned within said recirculation passage between said exhaust gas pressure responsive valve assembly and said exhaust manifold, said exhaust gas pressure responsive valve assembly comprising:

a first body of resinous material, a second body of metal material, a holder of resinous material welded to said first body to thereby hold said second body therebetween, a diaphragm member arranged within both of said bodies and having an outer periphery held between said bodies so as to thereby define an atmospheric chamber on the side of said resinous body and an exhaust gas pressure chamber on the side of said metal body and leading to said recirculation passage, said diaphragm member being movable in response to exhaust gas pressure within said exhaust gas chamber, spring means biasing said diaphragm member against the exhaust gas pressure within said exhaust gas chamber, in inlet port provided in said resinous body for receiving said vacuum signal produced responsive to the opening degree of said throttle valve, an outlet port provided in said resinous body and leading to said vacuum chamber of said valve means, a passage provided in said resinous body for connecting said inlet and outlet ports, at least one metal plate secured to said diaphragm member, a guide member of resinous material secured to said metal plate, and valve means arranged within said guide member for controlling fluid communication between said passage and said atomspheric chamber in response to movement of said diaphragm member.

8. An exhaust gas recirculation system as set forth in claim 7, further comprising a further valve means arranged within said recirculation passage between said exhaust manifold and said exhaust gas pressure responsive valve assembly, said further valve means being adapted to interrupt said recirculation passage when the exhaust gas pressure increases unexpectedly.

* * * * *